United States Patent [19]

De Martelaere

[11] 3,941,172

[45] Mar. 2, 1976

[54] CATALYTIC CONVERTER CHANGER DEVICE

[75] Inventor: David L. De Martelaere, Troy, Mich.

[73] Assignee: Kent-Moore Corporation, Warren, Mich.

[22] Filed: Jan. 15, 1975

[21] Appl. No.: 541,265

[52] U.S. Cl. ..... 141/392; 285/62; 285/158; 285/392

[51] Int. Cl.[2] ..... B65B 1/04

[58] Field of Search ..... 285/392, 357, 61–64, 285/158; 141/12, 67, 68, 71–80, 5, 8, 65, 84, 93, 98, 369, 382–389, 340, 392; 222/193; 23/288 F

[56] References Cited

UNITED STATES PATENTS 3,865,159 2/1975 Mayfield ..... 141/67

*Primary Examiner*—Houston S. Bell, Jr.
*Attorney, Agent, or Firm*—Burton and Parker

[57] ABSTRACT

Catalytic converter emptying and filling device attachable to the housing of a catalytic converter containing a bed for storing catalytic pellets. In such a converter the housing is formed of inner and outer walls separated slightly from one another to form a space therebetween which is filled with heat insulating material. The inner and outer walls of the housing each have a port registering with the other port for emptying and filling the bed of the converter. The changer device includes a rigid conduit or pipe connectible to the port for passing the pellets to a receptacle or canister rigidly attached to the pipe for receiving the pellets from the converter and further including a vibrating instrumentality rigidly attached to the device for imparting vibrational turbulence to the rigid assembly making up the device. A feature of the device is the provision having the function of clampingly securing one end of the pipe to the inner wall of the converter housing to translate the vibratory motions directly to the inner wall and storage bed of the housing and the further function of connecting one end of the pipe to the housing port for passing the catalytic pellets in either direction therethrough.

15 Claims, 6 Drawing Figures

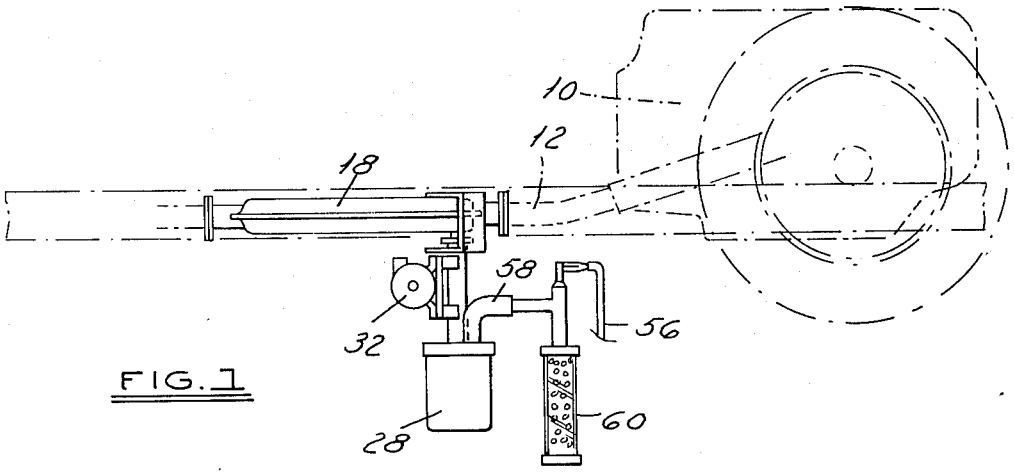
FIG. 1
FIG. 2
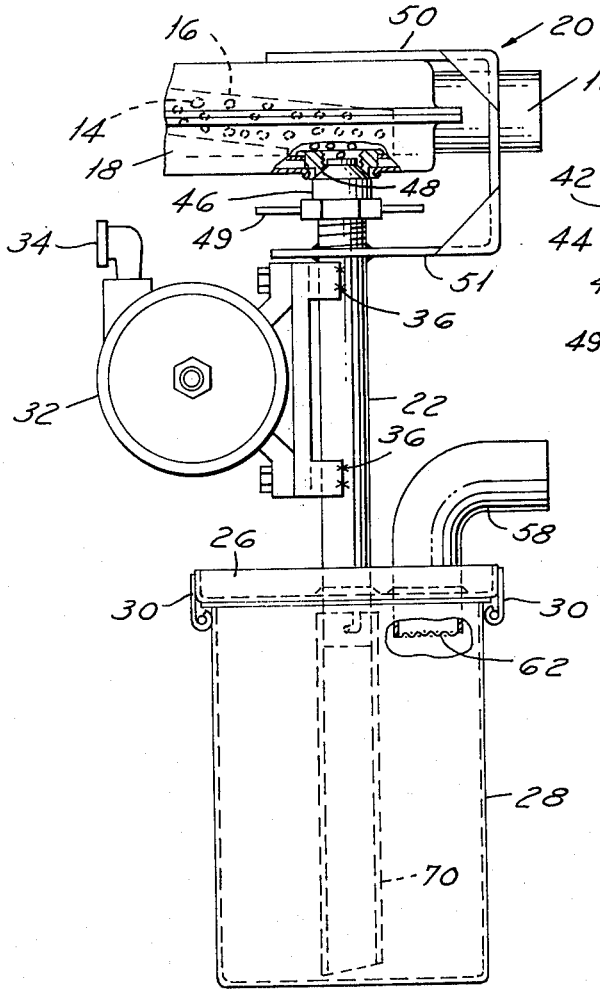
FIG. 3
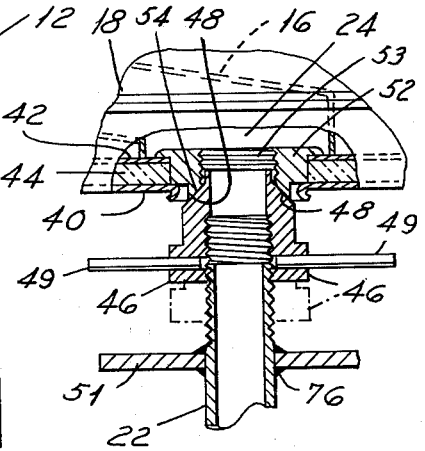

CATALYTIC CONVERTER CHANGER DEVICE

CROSS-REFERENCE TO RELATED PATENT APPLICATION

Reference may be made to the application for patent filed in the name of William G. Clogg entitled CATALYTIC CONVERTER EMPTYING AND FILLING DEVICE, Ser. No. 456,833, filed Apr. 1, 1974, which discloses and claims subject matter herein disclosed but not claimed.

BACKGROUND OF THE INVENTION

With the increased emphasis in attempting to purify atmospheric air, various techniques have been suggested for controlling the pollutants which are emitted from internal combustion engines. One of the means suggested is the use of a catalytic converter which employs various catalysts to purify the exhaust fumes of the internal combustion engine. The catalyst in such a purifier is generally pellet or small bead size, normally substantial spherical, having a diameter of about 0.02 to about 0.25 inches. The pellets catalyze the conversion of the impurities in the exhaust to non-toxic gases. Generally such catalysts are precious metal or noble metal calalyst such as platinum, palladium and the like, although base metals may also be employed. Such metals are carried by or bonded to inert, high heat resistant porous substrate material, such as alumina or the like granules, having the aforesaid dimensions. The difficulty with such catalytic converters is the need for periodically replacing the catalyst which have served their pujrpose for a period of time or have become contaminated due to the presence of lead in gasoline.

Various techniques have been suggested for maintenance of the catalytic exhause purifier such as that disclosed in U.S. Pat. to Calvert No. 3,184,291 as well as U.S. Pat. to Grandy No. 3,295,565 which are hereby incorporated by reference. The difficulty with the prior art has heretofore been the production of a satisfactory means for practically, efficiently and consistently removing the pellets from catalytic converters and filling the same.

Accordingly, it is an important object of the present invention to provide an improved catalytic converter emptying and filling device and particularly one which is highly efficient in its emptying and filling operations.

Another important object of the invention is to provide a lower cost and lighter weight apparatus for emptying and filling catâlytic converters.

SUMMARY OF THE INVENTION

The present invention is concerned with an improved catalytic converter emptying and filling device which has the capability of consistently filling and removing catalytic pellets, the latter action preferably assisted by gravity, from a catalytic converter. As recited in the aforesaid referenced patent application, the apparatus involved is rigidly constructed and rigidly affixed to the catalytic converter or exhaust purifier of the internal combustion engine automobile by means of a clamping device or the like. A conduit or pipe of rigid material is rigidly affixed at one end to the port in the catalytic converter through which spent catalyst pellets will flow to a receptacle or canister also rigidly affixed to the opposite end of the pipe. A vibrating means is attached to the device for imparting rapid vibratory motion to the catalytic converter to assist in the movement of the pellets as they pass from the catalytic bed in the converter through the pipe and into the receptacle. Preferably the receptacle or canister is rigidly affixed to the pipe. As pointed out in the referenced patent application, this provides the distinct advantage that the motion of the vibrator will facilitate the continuous vibrator movement of the entire apparatus including the converter housing and contents. Accordingly, as the exhaust purifier or catalytic converter is vibrated, then the distant receptacle will likewise vibrate in phase with the purifier.

Because of the high heat developed by the catalytic converters, it is the present practice to enclose the inner metallic converter casing with an outer insulating cover or casing of thinner metal which is spaced from the inner casing and to fill the intervening space with heat insulating material. The use of such yielding or compressible insulating material produces a dampening effect to shocks, such as produced by the vibrator, and requires a larger size vibrator to overcome this disadvantage. This difficulty is avoided by making direct metallic contact between the inner casing of the converter and the pellet conveying tube or pipe. Moreover, this provision forms part of the clamping mechanism for rigidly securing the emptying and filling device to the catalytic converter. Thus, this dual functioning arrangement not only enables a lower cost and lighter weight vibratory device to be used but also avoids the necessity of a second component for assuring a firm clamping connection of the emptying-filling device to the converter unit.

BRIEF DESCRIPTION OF THE DRAWING FIGURES

Various other objects, advantages and meritorious features of the invention will become more fully apparent from the following specification, appended claims, and accompanying drawing Figures wherein:

FIG. 1 is a side view of the underside of an automobile revealing in phantom the internal combustion engine and the exhaust system thereof and further showing in full line the installation of a catalytic converter in the exhaust system and the attachment of an improved device embodying the invention for emptying and filling the catalytic converter;

FIG. 2 is an enlarged view of the improved device of FIG. 1 and the housing of the catalytic converter, the latter being partially broken away to illustrate the improved connection therebetween;

FIG. 3 is a further enlarged detail view of the improved connection of FIG. 2 and showing in full and dotted lines two positions of the adjustable cap on the pipe which also serves as part of the clamping mechanism for securing the device to the catalytic converter;

DESCRIPTION OF A PREFERRED EMBODIMENT

Figure 4:
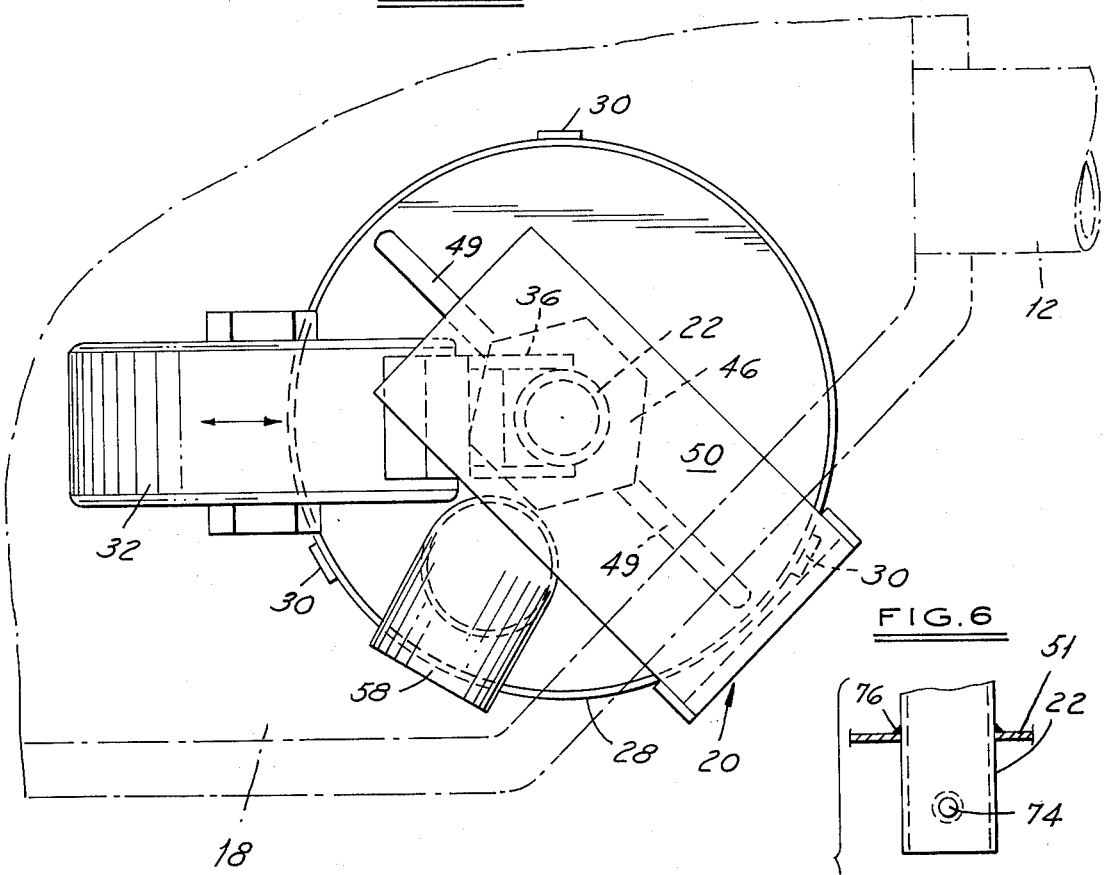
FIG. 4 is a top plane view of the catalytic converter changer showing in dotted outline a suggested mounting relationship with respect to an automobile exhaust system.

With reference to the drawing Figures, FIG. 1 illustrates in general, an internal combustion engine 10 and an exhaust system 12 extending rearwardly thereof as is customary in automobiles. When it has been determined that the pellets 14 in the inclined foraminous bed 16 of the exhaust purifier or catalytic converter 18 need to be rejuvenated or replaced, the emptying device of the present invention is rigidly attached to the catalytic converter, preferably by means of an adjustable C-shaped clamping frame 20 and associated parts to be described in detail hereinafter. During emptying of the pellets from the catalytic converter, a tube or pipe 22 of rigid material has one end section thereof entering the outer enclosure of the converter and snugly and firmly fitting into a port generally indicated at 24 (FIG. 3) of the catalytic converter in such a manner as to prevent dust from the pellets from passing to the surrounding environment. The opposite lower end section of the pipe 18 is rigidly affixed to a disc shaped member 26 which serves as a cover for a pail or canister 28. The canister is clampingly secured to the cover member by any suitable means such as a plurality of circularly spaced apart spring clamps 30 which releasably engage the underside of the lip of the pail in the manner shown in FIG. 2. The device of the present invention further employs a vibrating component 32 which is herein shown as an air operated vibrating means having an air pressure inlet 34 for connection to a suitable source of air pressure. The vibrator 32 is preferably rigidly attached to the pipe 18 such as by weld joints indicated at 36.

It is evident from the description thus far that when the catalytic changing device is attached to the catalytic converter 18 it forms a rigidly connected appendage of the converter. When the vibrator 32 is operated not only do the parts of the device vibrate in unison or in phase with one another but the converter is also vibrated in phase with the device. In the emptying operation the pellets 14 will "dance" down the inclined catalytic bed 16 and through the straight tube 18 and into the canister 28.

It should be appreciated that different vibrating means may be employed such as electrical, mechanical, sound vibrators and the like. In addition, although preferred, the vibrating means need not be rigidly or fixedly atached to the pipe 22 but instead it may be rigidly affixed to the catalytic converter 18 or some other portion of the internal combustion engine vehicle or to the canister 28. However, the vibrator should be sufficiently forceful enough to cause the pellets to pass down the inclined bed 14 through the pipe 22 and into the canister 28, and although aided by gravity the pellets are rapidly urged by the uniformly distributed vibrations imparted to all of the parts of the apparatus through which the pellets are fed.

When all of the components of the present invention are rigidly and securely held in place, then there is no dampening effect to counter-balance the vibrator 32. In the development of this invention it was found that such dampening reactions to the vibratory motions severely limit the ability of a reasonably sized vibrating device to sufficiently vibrate the snugly packed pellets in the catalytic bed and cause them to pass from the bed by gravity through the conduit 22 and into the receptacle 28. Such undesirable dampening effects occur if the catalytic converter, conduit means and finally the canister are unable to vibrate in phase with the vibrator.

As earlier pointed out herein, the usual catalytic converter changer unit is a double walled structure with insulation disposed between its metallic walls. In the operation of the converter unit, the temperature within the inner casing thereof may approximate 1000°F, and the purpose of the insulation and the double walls is to prevent the heat from the extremely hot catalytic pellets as well as the pellets themselves from penetrating to the exterior of the unit. The enlarged view of FIG. 3 best shows the double walled formation of the catalytic converter. The outer insulation wall is indicated at 40 and the inner wall at 42 with the space therebetween containing heat insulative material 44. If the catalytic converter changer is clamped to the outside wall of the converter, the insulation 44 will dampen the vibrations with the result that the foraminous character of the bed 14 is either insufficiently vibrated for emptying or filling the pellet bed or a much stronger vibrator is required to accomplish the desired vibratory action. The present invention solves two problems by the expedient of one provision, namely, a sleeve or nut 46 having internal threads which are engaged with external threads on the upper end of the type 22 and therefore is capable of threaded advancement up and down on the tube as illustrated by the two positions of the nut in FIG. 3. The nut is capped by a hollow conical section 48 which is shaped to partially enter the port or mouth 24 of the foraminous bed 14 in which the pellets lie. Carried by the nut are two diametrically oppositely positioned handles 49—49 for facilitating the turning of the nut on the tube.

One problem solved by the nut 46 is its function as a part of the mechanism for clamping the catalytic changer to the converter unit. As shown in FIG. 2 the C-shaped frame 20 straddles the converter unit 18 with its upper arm 50 in engagement with the upper outer wall of the converter and its lower arm 51 spaced from the underside of the converter and fixedly secured by welding or the like to the rigid conduit 22. When the nut is threaded upwardly into engagement with the mouth of the port 24, it serves as an adjustable extension of the tube 22 and cooperates with the upper arm 50 of the frame 20 to firmly clamp the converter unit therebetween.

Fitted into the opening formed by the registering ports of the outer and inner casings 40 and 42 of the converter unit is a ring-shaped member or collar 52 serving as the lip or mouth for the two ports. The ring member has an axial dimension approximating the thickness of the two walls of the converter unit and may be shaped as shown with externally projecting flanges which overlap the marginal portions of the walls surrounding the ports and which are welded or otherwise secured thereto. The internal wall of the ring member 52 is divided into an upper internally threaded section 53 for receiving a removable externally threaded sealing plug (not shown) and a lower outwardly flaring conical section 54 inclined at the same angle as the conical surface of the nut 46 for full seating engagement therewith. It is apparent that such a clamping arrangement makes metallic contact between the nut 46 and the mouth 24 of the converter unit and solves the problem of transmitting the vibratory motion directly to the inner wall 42 of the converter unit rather than going through the outer wall and the insulation 44. Moreover, this improvement avoids the need for a separate clamping and unclamping actuator component in the form of a toggle device, such as employed on the catalytic converter changer disclosed in the aforesaid Clogg patent application.

During the operation of the catalytic converter changer it has been found to be extremely helpful as well as beneficial from the pollution standpoint to employ vacuum in combination with the vibratory motion to induce travel of the particulate catalyst in the desired direction. For this purpose a nearby vacuum source 56 may be provided which as shown in FIG. 1 communicates with the pail-like receptacle 28 by means of a right angled pipe section 58 and an aspirator device 60 for capturing dust particles that escape the canister 28. As shown in FIG. 2 the inlet end of the pipe 58 may be screened as at 62 for retaining the catalyst granules in the canister. The draft created by the vacuum source is shown in FIGS. 1 and 2 as being in the direction for emptying the catalyst granules from the converter unit 18. In so doing some atmospheric air will be drawn into the discharge end of the vehicle exhaust pipe and muffler and into the converter unit, and a little air may be induced to enter the converter by way of the carburetor intake and exhaust valves of the engine.

Figure 5:
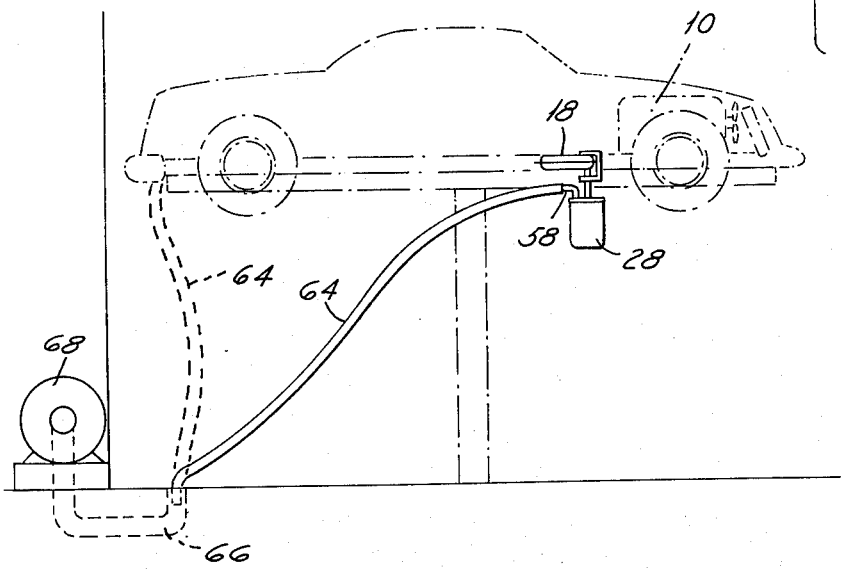
FIG. 5 is a side view of a hook-up for removing catalytic pellets by vacuum.

FIG. 5 illustrates an alternate way of siphoning air through the converter unit and changer assembly to facilitate the catalyst emptying operation. Instead of employing the aspirator device as in FIG. 1, a lengthy flexible hose 64 may be directly connected at one end to the vacuum outlet pipe 58 and at the opposite end to an underground outlet 64 leading to an air vacuum pump 68 external of the automobile service garage in which the catalyst empyting operation is being performed. A similar arrangement is commercially known as the Monoxivent (TM) exhaust system developed by the assignee of the present invention and disclosed in U.S. Pat. No. 2,733,668 for exhausting dangerous carbon monoxide fumes from service garage stalls and the like. The high vacuum provided by the large vacuum pump enables the emptying operation to be performed rapidly with a minimum of dust and noise.

Figure 6:
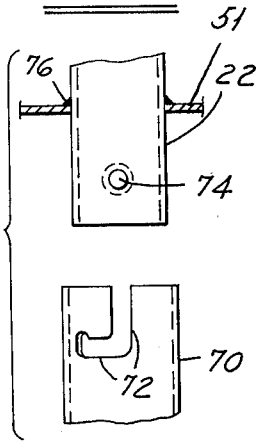
FIG. 6 is an enlarged detail view for showing how the rigid tube may be extended into a canister for refilling the bed of the catalytic converter.

The same Monoxivent exhaust system may be used for rapidly filling the bed 16 of the converter unit. The hose 64 in this event could be attached to the discharge end of the tail pipe of the vehicle's exhaust system. Before operating the Monoxivent system, the rigid tube 22 would be provided with a detachable extension 70 shown in FIG. 2 as having a length such as to approach the bottom of the canister 28 when the latter is mounted in place on the catalytic changer device by the spring clamps 30. However, prior to such mounting, the same or similar canister is filled with fresh catalytic pellets and then releasably installed in position against the underside of the cover member 26 by the clasps 30. A suitable provision for releasably attaching the extension 70 to the tube 22 is shown in FIG. 6 where the adjacent ends of the two parts are shaped for telescoping fit and where one of the parts, in this instance the extension, is provided with a bayonet slot 72 in which a projecting button 74 on the tube 22 is received and rotatably interlocked against accidental separation. FIG. 6 also shows the welded connection 76 for fixedly securing the cover member 26 to the tube 22.

With the parts so assembled and the canister filled with unused catalytic material, the inlet end of the hose 64 of the Monoxivent system is attached with a suitable coupling provision to the discharge end of the vehicle's exhaust system as shown in FIG. 5 and the vacuum pump 68 and the vibrator 32 are set into operation. It is to be understood that reasonable precautions should be undertaken to seal any serious openings in the fluid system that might adversely effect the vacuum action, such as by closing the vacuum outlet pipe 58 or removing it from the opening provided in the cover therefore and sealing such opening. So conditioned, the combined action of the vibrator 32 and the high vacuum created by the pump 68 will generate enough forces to induce the fresh catalytic pellets to travel upwardly out of the canister 28 and through the tube 22, and thence through the clamping nut 46 and into the bed 16 of the catalytic converter unit.

After the foraminous bed 16 of the converter unit has been filled or replenished with catalytic pellets, the clamping nut is retracted from the port 24 by rotating the handles 49—49 in the proper direction to lower the nut and thus unclamp the changer device from the converter unit. When sufficient clearance has been reached, the straddling clamping frame 20 may be slid off of the edge of the converter unit thus removing the changer device from attachment to the vehicle. The opened port 24 may be closed by a suitable sealing plug (not shown) which is threaded to engage the internal threads 53 on the ring-shaped member of the port shown in FIG. 3. It is evident from FIG. 3 that when the clamping nut is raised on the tube 22 its hollow conical nose 48 will seat against the mouth of the port regardless of any variation in the radius of the port opening within the limits of the minimum and maximum dimensions of the conical nose of the clamping nut.

It is also to be noted that in FIGS. 1 and 2 the axis of the vibrator 32 extends perpendicular to the plane of the C-shaped clamping frame 20 whereas in FIG. 4 the vibrator axis extends at an oblique angle to the frame. The latter view is the preferred mounting arrangement of the vibrator in order that its vibratory motion may extend in the general direction of the inclined catalytic bed. This will facilitate the emptying of pellets from and the feed of pellets into the bed.

While a particular embodiment of the invention has been illustrated and discussed, it will be understood, of course, that it is not desired that the invention be limited thereto since modifications may be made. It is therefore contemplated by the appended claims to cover any such modifications as fall within the true spirit and scope of the invention.

What is claimed is:

1. A catalytic converter changer device for emptying or filling a catalytic converter unit with catalytic pellets and comprising, in combination:

a tube composed of rigid material and forming a catalytic pellet conveying conduit;

a generally C-shaped clamping member having the two arms of its C-shaped configuration sufficiently spaced apart to straddle a catalytic converter unit, one arm of its C-shape being fixedly secured to one end section of the tube and such that the balance of the C-shaped member is extendable around a converter unit in straddling relation thereto with the result that the two arms of its C-shape configuration lie adjacent to corresponding areas of the opposite sides of the converter unit; and a sleeve fitting said end section of the tube and being adjustable axially of the tube to serve as a variable extension thereof, said sleeve being operable when axially extended relative to the end section of the tube to engage the lip of a port to the interior of the converter unit to serve as a conveyance of catalytic pellets therethrough and also being operable when so extended to cooperate with the second arm of the C-shaped member to clamp the converter unit therebetween.

2. The catalytic changer device of claim 1 wherein the axial adjustability of the sleeve is accomplished by interengaging screw threads on the sleeve and the end section of the tube and by relative rotation of the sleeve with respect to the tube.

3. The catalytic changer device of claim 2 wherein a cover member for a receptacle is rigidly secured to the other end of the tube and is provided with means for releasably securing a receptacle thereto.

4. The catalytic changer device of claim 3 wherein the cover member is provided with a vacuum outlet pipe for connection to a source of vacuum.

5. The catalytic changer device of claim 4 wherein a vibrating mechanism is rigidly secured to the tube and when actuated will vibrate all rigidly secured parts of the device in unison.

6. The catalytic changer device of claim 5 wherein the outer end of said sleeve is provided with a conical surface for engaging the lip of a port to the interior of a catalytic converter unit.

7. The catalytic changer device of claim 1 wherein a receptacle is releasably yet rigidly secured to the other end of the tube.

8. The catalytic changer deivce of claim 7 wherein the receptacle is provided with an outlet for connection to a source of fluid pressure differing from that of atmospheric air.

9. The catalytic changer device of claim 1 wherein the outer end of the sleeve is provided with an outwardly facing conical surface for engaging the lip of a port opening into the interior of a catalytic converter unit.

10. The catalytic changer device of claim 9 wherein the lip of the port to the interior of a catalytic converter unit is constituted by a ring-shaped member having an inwardly facing conical surface extending at an angle corresponding to that of the conical surface of the sleeve and forming an annular seat therefor.

11. A catalytic converter changer device for either emptying or filling a catalytic converter unit with catalytic pellets and comprising, in combination:

a catalytic converter unit of double-walled thickness having the space between the walls filled with heat insulating material and further having a segregated area therein for storing catalytic pellets, said converter unit having a port in each of the double walls which register with one another for the passage of catalytic pellets either into or out of the unit, and a ring-shaped member having an axial dimension approximating the double-walled thickness of the converter unit and fittingly engaging the margins of the registering ports of the converter unit, said ring-shaped member having a conical surface flaring outwardly externally of the unit to form a tapered seat common to the two ports;

a tube composed of rigid material and forming a catalytic pellet conveying conduit;

a generally C-shaped clamping member having the two arms of its C-shape configuration sufficiently spaced apart to straddle a catalytic converter unit, one arm of its C-shape being rigidly secured to one end section of the tube and so that the balance of the C-shaped member is extendable around the converter unit in straddling relation thereto with the result that the two arms of its C-shape configuration lie adjacent to corresponding areas of the opposite sides of the converter unit; and a sleeve fitting said end section of the tube and being adjustable axially of the tube to serve as a varying extension thereof, said sleeve having the outer end thereof provided with a conical surface matingly engageable with the conical surface of the ring-shaped member and being operable when axially extended to bring the two conical surfaces into such engagement and being further operable when so extended to cooperate with the second arm of the C-shaped member to clamp the converter unit therebetween.

12. The catalytic changer device of claim 11 wherein the axial adjustability of the sleeve is accomplished by interengaging screw threads on the sleeve and the end section of the tube accompanied by relative rotation of the sleeve with respect to the tube.

13. The catalytic changer device of claim 12 wherein a cover member for a receptacle is rigidly secured to the other end of the tube and is provided with means for releasably securing a receptacle thereto.

14. The catalytic changer device of claim 13 wherein the cover member is provided with a vacuum outlet pipe for connection to a source of vacuum.

15. The catalytic changer device of claim 14 wherein a vibrating mechanism is rigidly secured to the tube and when actuated will vibrate all rigidly secured parts of the device in unison.

* * * * *